US006502814B2

(12) United States Patent
Focke et al.

(10) Patent No.: US 6,502,814 B2
(45) Date of Patent: Jan. 7, 2003

(54) APPARATUS FOR HANDLING BLANKS IN PACKAGING MACHINES

(75) Inventors: Heinz Focke, Verden (DE); Helmut Granz, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/892,111

(22) Filed: Jun. 26, 2001

(65) Prior Publication Data

US 2002/0000690 A1 Jan. 3, 2002

(30) Foreign Application Priority Data

Jun. 30, 2000 (DE) ..... 100 31 098

(51) Int. Cl.[7] ..... B65H 3/44; B65H 5/26

(52) U.S. Cl. ..... 271/9.12; 271/11; 271/95; 271/101; 271/106

(58) Field of Search ..... 271/9.01, 9.12, 271/11, 90, 94, 95, 96, 100, 101, 106, 107, 108, 18, 18.3

(56) References Cited

U.S. PATENT DOCUMENTS

| | | | | | |
|---|---|---|---|---|---|
| 769,747 | A | * | 9/1904 | Hoag | 271/101 |
| 1,039,521 | A | * | 9/1912 | Green | 271/101 |
| 3,861,667 | A | * | 1/1975 | Jahme | 271/11 |
| 4,021,293 | A | * | 5/1977 | Total et al. | 271/95 |
| 5,028,043 | A | * | 7/1991 | Karolyi et al. | 271/90 |
| 5,314,178 | A | * | 5/1994 | Cole et al. | 271/18.3 |
| 5,472,184 | A | * | 12/1995 | Focke et al. | 271/95 |

FOREIGN PATENT DOCUMENTS

| | | | | |
|---|---|---|---|---|
| DE | 33 28 322 | | 2/1985 | |
| DE | 37 38 102 | | 5/1989 | |
| DE | 39 05 214 | | 8/1990 | |
| DE | 43 34 745 | | 4/1995 | |
| EP | 0350749 | * | 1/1990 | 271/107 |

OTHER PUBLICATIONS

Copy of German Patent Office Search Report (Deutsches Patent–und Markenamt Ergebnis einer Druckschriftenermittlung).

* cited by examiner

*Primary Examiner*—H. Grant Skaggs
(74) *Attorney, Agent, or Firm*—Technoprop Colton LLC

(57) ABSTRACT

For removing blanks (10) from a blanks magazine (14, 15) a transfer roller (18, 19) is employed which grips the blank (10) with a suction head (20) and takes it along its circumference. The transfer roller (18, 19) must be moved back and forth along a linear path of movement below the blanks magazine (14, 15) by rotating about its own axis. This movement is driven by a crank gear —crank arm (24) and strut (26) —which are directly, i.e. by means of a swivel arm (28), connected to the transfer roller (18, 19). A differential gear (23) acts to produce a linear movement of the transfer rollers (18, 19).

12 Claims, 7 Drawing Sheets

71/72
42
70
68
69
70
14/15
41
20
16
66
67
45
43/44
18/19

71/72
18/19
16
70
42
41
69
68
14/15
43/44
70
18/19
45
10
67
13
20
66

APPARATUS FOR HANDLING BLANKS IN PACKAGING MACHINES

BACKGROUND OF THE INVENTION

1. Technical Field

The invention relates to an apparatus for handling blanks in a packaging machine, in particular for the manufacture of cigarette packs of the hinge-lid type, with a blanks magazine from which the blanks can be removed individually by a withdrawal assembly with a transport roller and fed to a discharge conveyor, it being possible for the transport roller to move back and forth at an open (bottom) side of the blanks magazine, taking a blank along its circumference in each case.

2. Prior Art

The removal of blanks from a blanks magazine is particularly difficult in high-performance packaging machines and their high rate of material handling. Known is a so-called transfer roller with a transport roller which can be moved back and forth on the lower, open side of the blanks magazine, in each case taking the bottom blank with it along its circumference. A crank mechanism transfers the back-and-forth movement to the transport roller. The latter is connected to a carriage which slides on stationary guide rails. This drive mechanism is not without problems. Above all, the largely open carriage guide is subject to contamination and dirt. Furthermore, it requires constant and sufficient lubrication, which can result in lubricant particles being transferred to the blanks and parts of the assembly.

BRIEF SUMMARY OF THE INVENTION

The invention is therefore based on the problem of providing an apparatus for handling blanks—in particular for their removal from the blanks magazine and transfer to a discharge conveyor—which requires less maintenance at higher performance and also reduces the risk of contamination.

For solving this problem, the apparatus according to the invention is characterized in that the transport roller is attached to a swivel arm, which is driven by a gear mechanism for pivoting back and forth so that the transport roller is moved back and forth along a straight path of movement.

The gist of the invention is to eliminate the carriage guide for the transport roller and to replace it with a mechanism which ensures a linear movement of the transport roller without a carriage guide.

Advantageous is a crank mechanism for the movement of the swivel arm in connection with a differential gear, which is configured so that the movement exerted by the swivel arm on the transport roller along a circular arc is compensated and converted into an exact linear movement. The differential gear includes a circumferential curve guide, which is connected to the swivel arm by means of an compensating lever, with the compensating lever, configured as a two-armed lever, causing the linear movement of the transport roller due to the corresponding adjusting movements of the swivel arm.

The control elements required in the gear mechanism according to the invention, namely in particular track rollers or jockey rollers in conjunction with curved paths, grooves or the like, are located separately in a closed housing and can thus be provided adequately with lubricants without affecting their surroundings.

Another advantage is that the apparatus can be configured for two-track operation, with two blanks magazines being positioned at a distance to each other which corresponds to the spacing of the connecting blanks paths. Each blanks magazine is assigned a transport roller. Both transport rollers can be moved back and forth at the same time by a common gear mechanism.

BRIEF DESCRIPTION OF THE DRAWINGS

Further special features of the invention will be explained below in more detail on the basis of exemplary embodiments of the apparatus, which show.

DETAILED DESCRIPTION OF THE PREFERRED EMBODIMENTS

Figure 6:
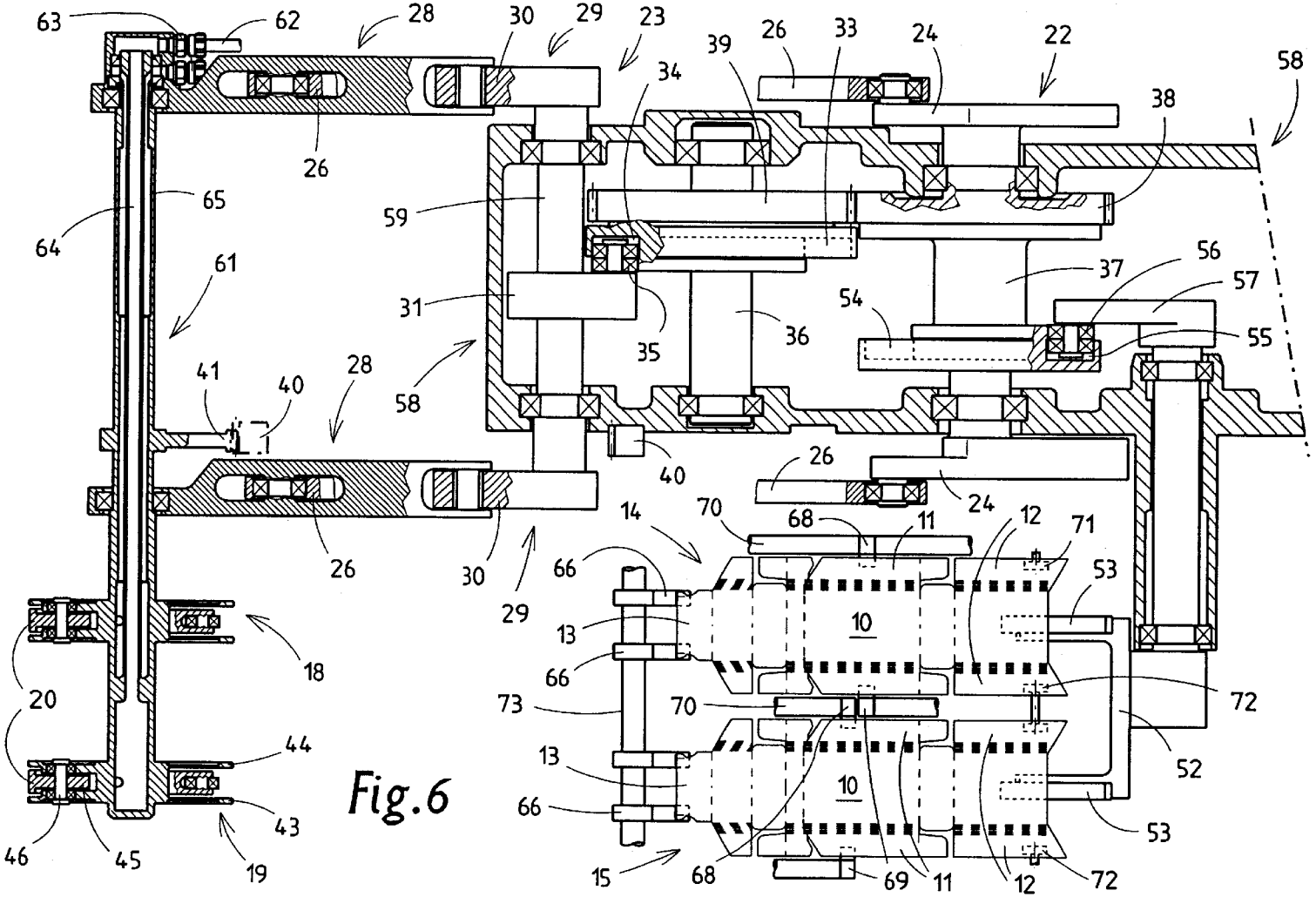
Figure 7:
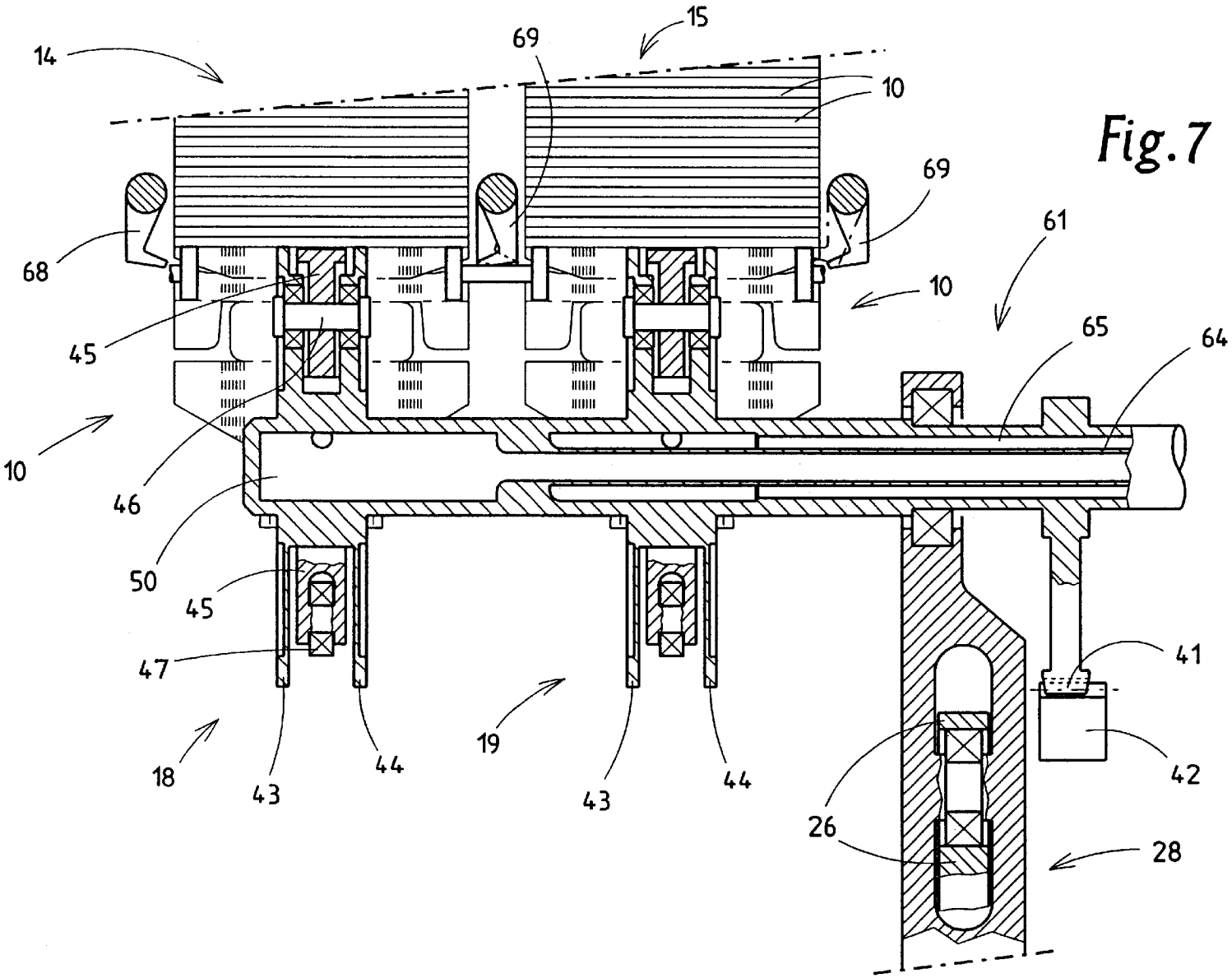

The exemplary embodiment shown in the drawings is an assembly for packaging machines for the manufacture of cigarette packs of the hinge-lid type. To this end, blanks 10 are processed which exhibit a contour characteristic for this type of pack (FIG. 6). Of interest in this connection are side tabs 11, 12 and lid inner tab 13.

The blanks 10 configured in this or a different manner are to be removed from a blanks magazine. In the present exemplary embodiment, the two blanks magazines 14, 15 are positioned directly adjacent to one another. Located in each of these blanks magazines 14, 15 is a stack of blanks 10.

The blanks 10 are taken individually from the blanks magazines 14, 15. The slightly tilted blanks magazines 14, 15 are open at their bottom side. The bottom blank 10 in each case is gripped by a withdrawal element and taken from the blanks magazine 14, 15. The blank 10 is transferred to a delivery conveyor, in the present case to conveying rollers 16, which convey the blank 10 away along a downward tilted blanks path 17.

Figure 3:
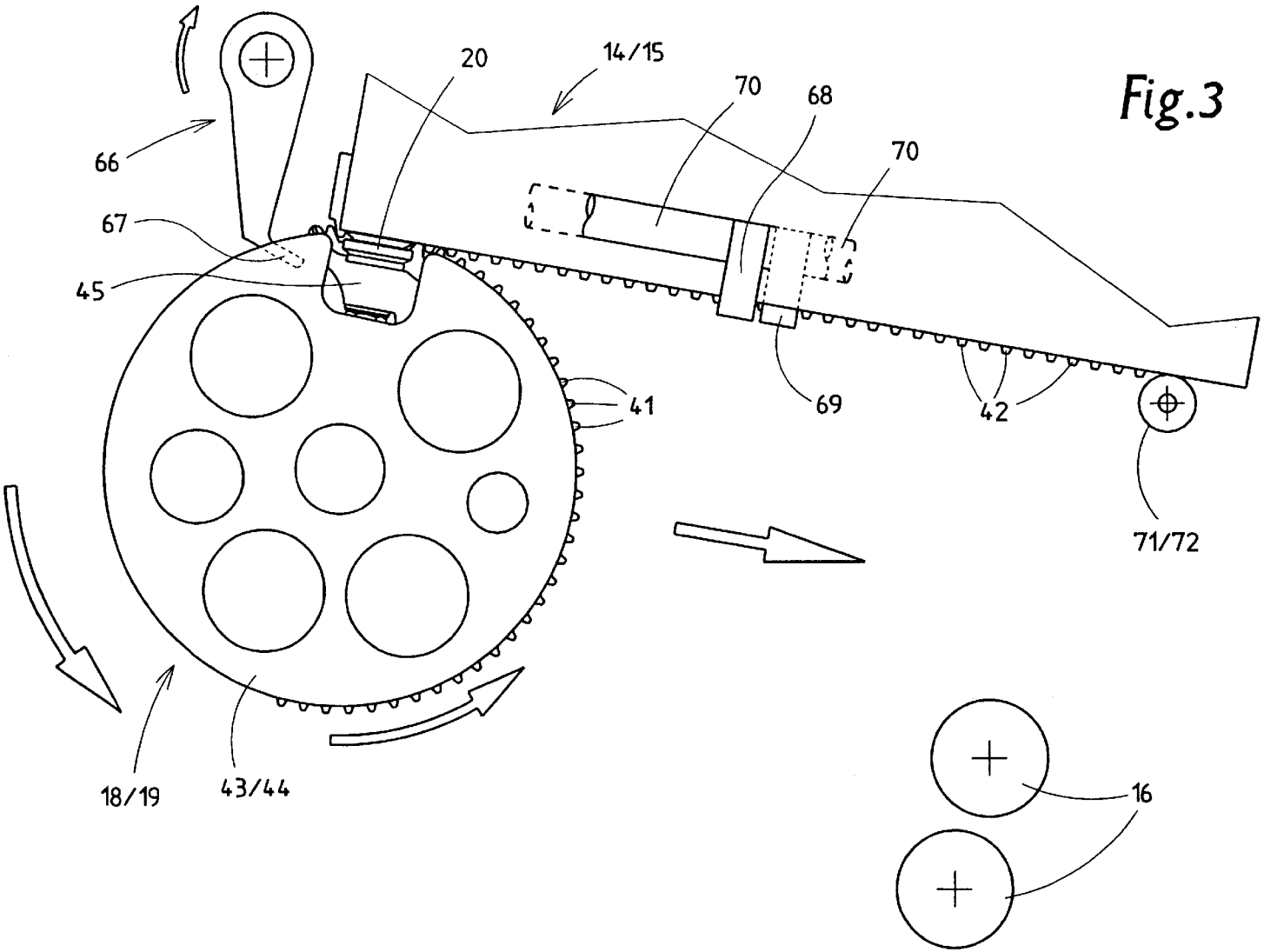
Figure 5:
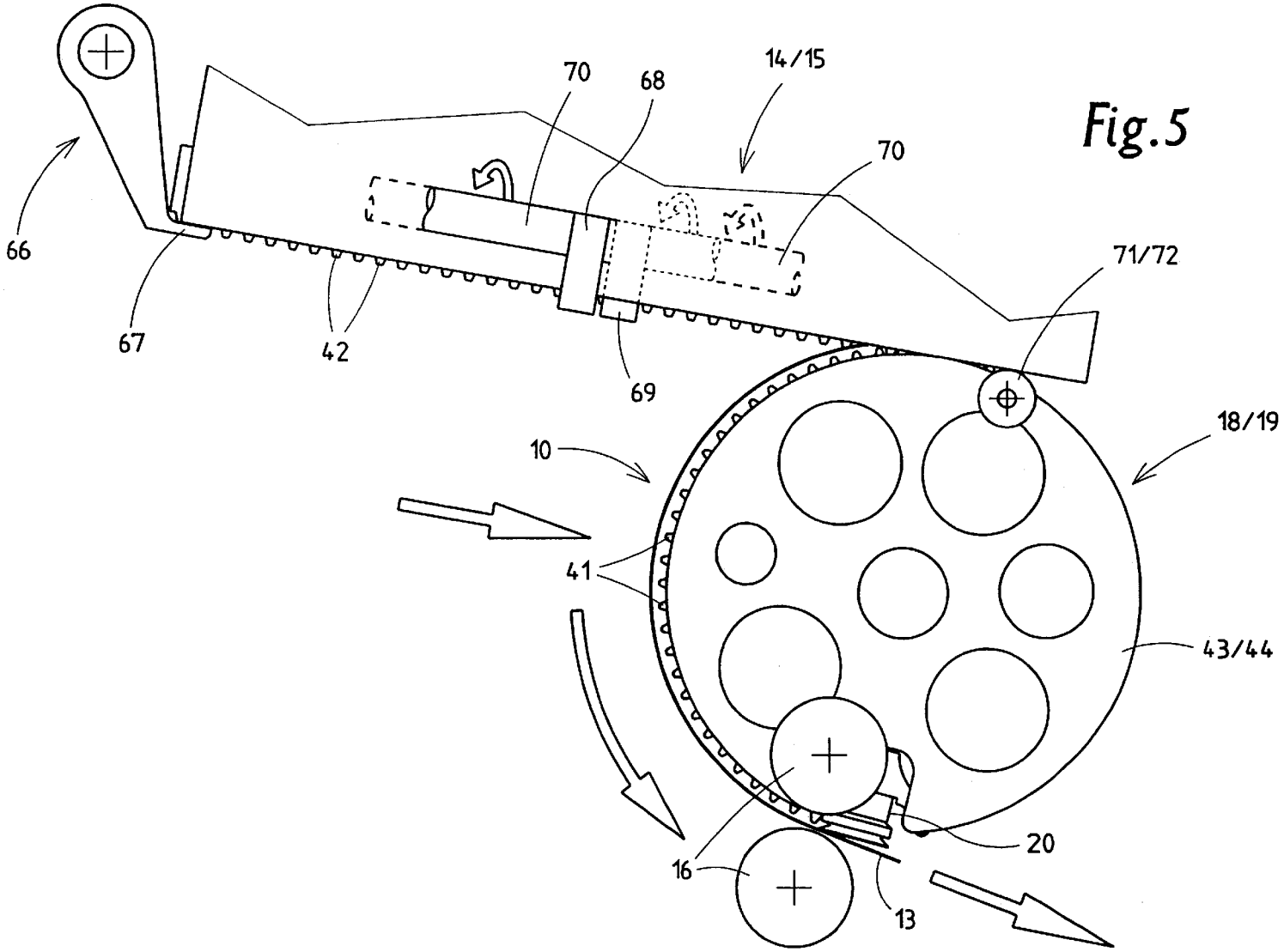

The withdrawal element is a transport roller 18, 19, which is moved back and forth at the open side of the blanks magazine 14, 15, namely from a receiving position pursuant to FIG. 3 to a transfer position pursuant to FIG. 5. The transport roller 18, 19 grips in each case a blank 10 with a gripping element, namely with a suction head 20. The latter acts at the circumference of the transport roller 18, 19. A blank 10 is gripped in an end region, namely in the region of the lid inner tab 13. By rotating the transport roller 18, 19 about its own axis and by additional linear movement along the bottom side of the blanks magazine 14, 15, the bottom blank 10 is gripped. In the process, the latter lies on the circumference of the transfer roller 18, 19. In the final position (FIG. 5) the end of the blank 10—lid inner tab 13—is inserted into the region between the two transfer rollers 18, 19. These transport the blank 10 further. The transfer roller 18, 19 then returns to its initial position by reverse motion.

The back-and-forth movement of the transfer roller 18, 19 occurs along an exactly straight path of movement—in terms of a center rotational axis. A special drive mechanism is provided for this, comprising a movement gear 22 and a differential gear 23. The movement gear 22 is a crank mechanism. A crank arm 24 can be rotated about a stationary pivot bearing. Attached to the free end of the crank arm 24 as a connecting rod is a strut 26 for transmitting the push or pull movements to the transfer rollers 18, 19. The crank arm 24 is connected to an opposite leveling piece 27 in order to balance the crank mechanism.

The movement gear 22 is connected to the transfer roller 18, 19 by means of a transmission member, namely a swivel arm 28. The transfer roller 18, 19 is rotatably mounted at a—lower—end of the swivel arm 28, namely in the region of its rotational axis. The other—upper—end of the swivel arm 28 is connected to the differential gear 23. The swivel arm 28 is swiveled back and forth by the movement gear 22, namely by the strut 26, and in the transverse direction, namely up and down, by the differential gear 23.

The differential gear 23 has a compensating member connected to the swivel arm 28, namely a (two-armed) compensating lever 29. The latter comprises two sublevers 30, 31, which are connected rigidly to one another in the region of a stationary tilting bearing. The two sublevers 30, 31 are arranged at an (obtuse) angle to one another. One end of the compensating lever 29 is pivotally attached to the free end of the swivel arm 28. The other end of the compensating lever 29 acts in conjunction with a control member, which causes the compensating movements to take place.

The control member is a stationary, yet rotatably mounted cam member. This is a disc cam 33 having an nearly elliptical control groove 34. Running in this groove is a guide roller 35, which is connected to the facing end of the compensating lever 29 or of the sublever 31. The disc cam 33 is mounted on a transmission shaft 36.

Figure 1:
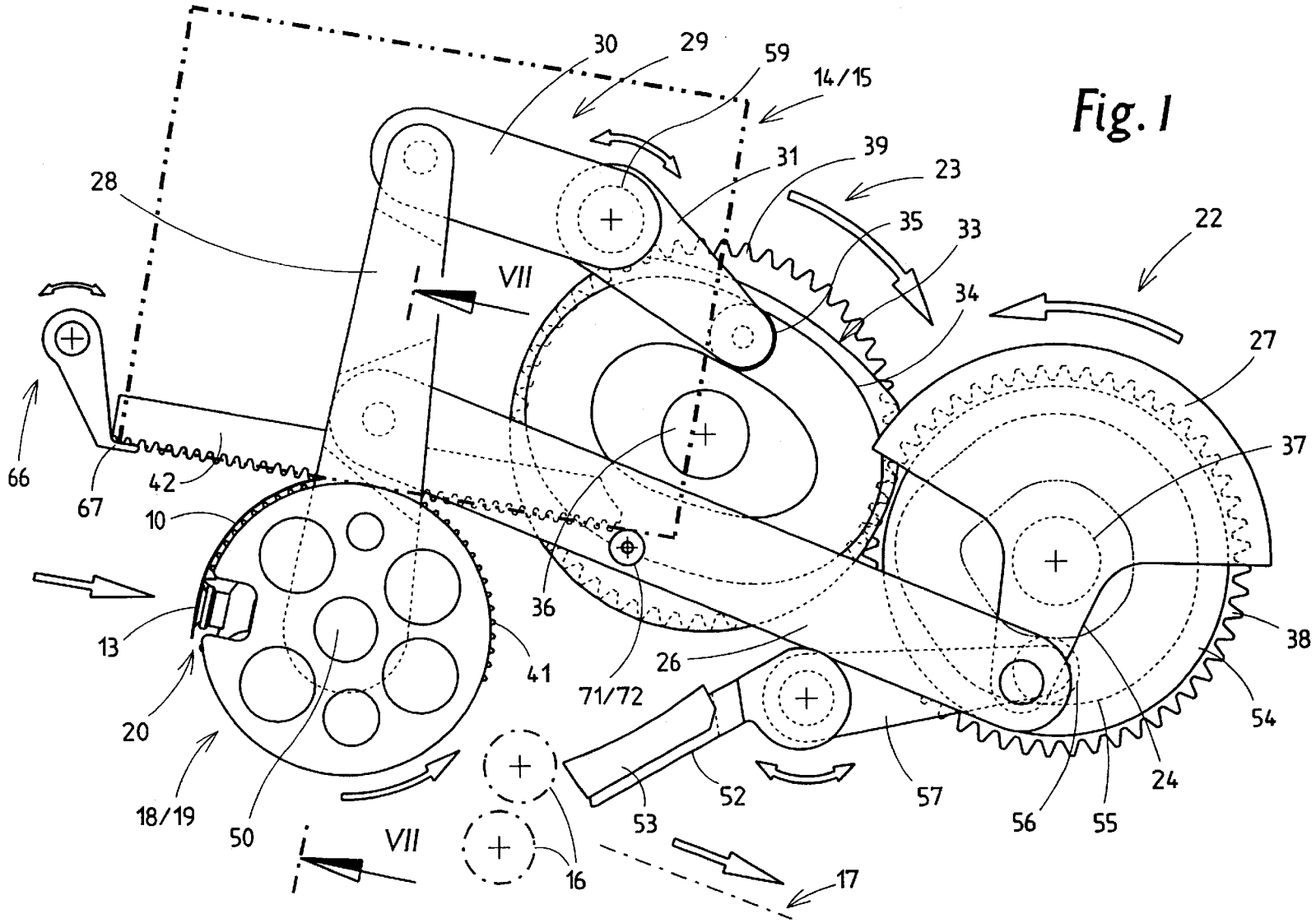
FIG. 1 a withdrawal assembly for transferring blanks from a blanks magazine, in schematic side view FIG. 2 the assembly according to FIG. 1, with an altered relative position of the displaceable elements, FIG. 3 to FIG. 5 various positions of elements of the assembly during the removal of a blank from the blanks magazine, side view, FIG. 6 the assembly according to FIG. 1 in top view or horizontal projection, FIG. 7 a cross section through the assembly according to FIG. 1 in a cross-sectional plane approaching the upright sectional plane VII—VII of FIG. 1.
Figure 2:
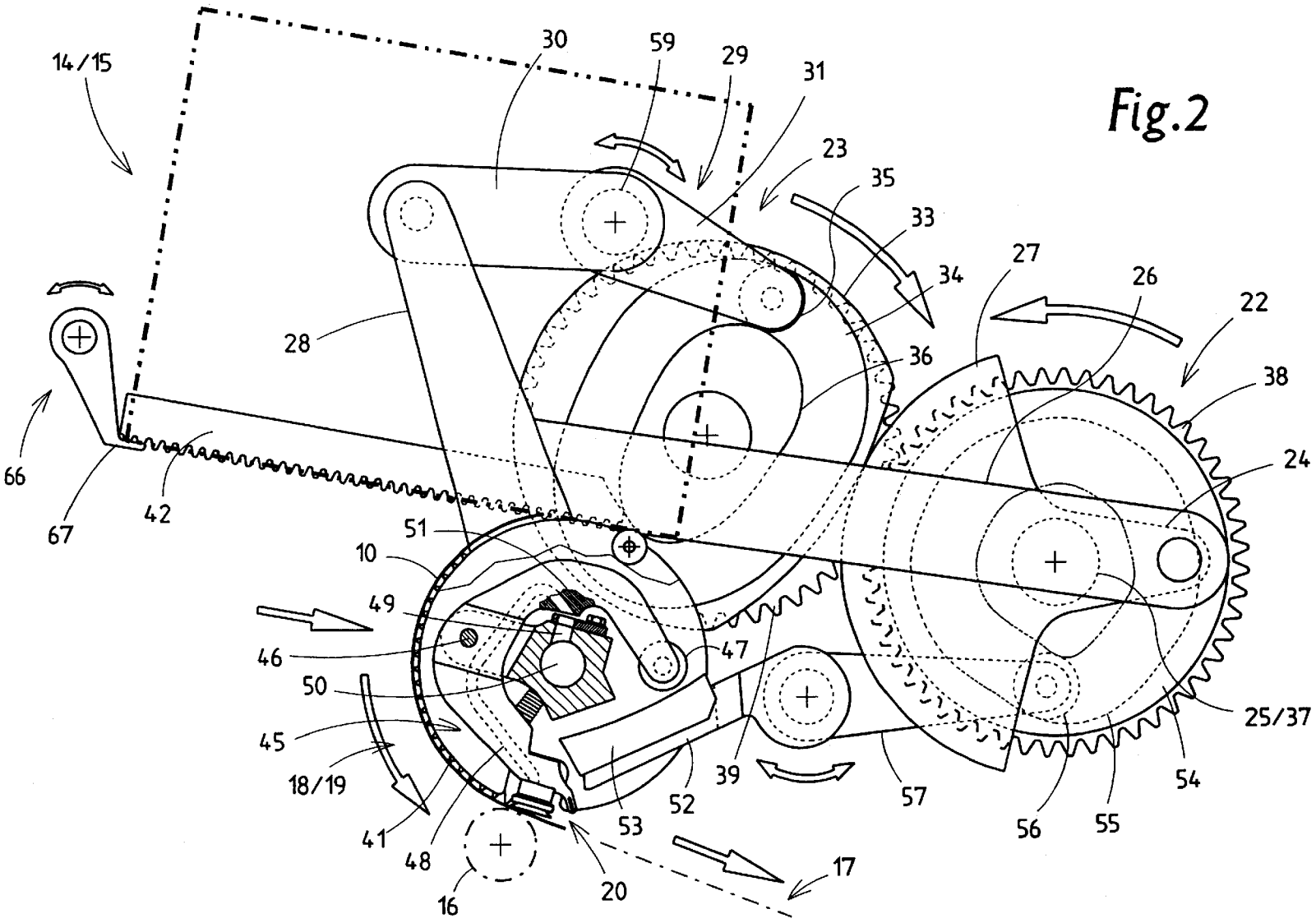

The differential gear 23 described above acts in conjunction with the movement gear 22 in order to ensure the straight-line back-and-forth movement of the transport roller 18, 19 along the plane of the respective bottom blank 10 in the blanks magazine 14, 15. At the same time, the compensating lever 29 executes tilting movements about the tilting bearing which result in a compensatory upwards or downwards movement of the swivel arm 28. FIG. 1 shows a middle position, FIG. 2 shows an end position.

Movement gear 22 and differential gear 23 are linked to each other. The crank mechanism or crank arm 24 is mounted on a transverse shaft 37. Located on the latter is a cog wheel 38, which combs with a further cog wheel 39 on the transmission shaft 36 of the disc cam 33. The transmission ratio of the cog wheels 38, 39 can be 1:1. Movement gear 22 and differential gear 23 thus run synchronously by virtue of their common drive.

The respective blank 10 to be conveyed away is gripped by the transfer roller 18 in an end position (FIG. 3). In the process, the suction head 20 is facing the blank 10 or blanks magazine 14, 15, specifically in a end region, here in the region of the lid inner tab 13. The blank 10 is gripped by negative pressure, namely by suction bores on the suction head 20. By means of the rotational movement of the transfer roller 18, 19 and superimposed (linear) transverse movement, the blank 10 is placed along the circumference of the transfer roller 18, 19. The rotational movement of the transfer roller 18, 19 is caused by the engagement of a toothed quadrant 41 at the circumference of the transfer roller 18, 19 with a stationary toothed rack 42.

One special feature is the controlled flow of suction air or negative pressure in the region of the suction head 20. The transfer roller 18, 19 comprises two roller discs 43, 44 arranged at a distance to one another. The suction head 20 is mounted between them, specifically on a—two-armed—actuating lever 45. The latter is shaped to run between the roller discs 43, 44 in an arc and can be tilted about a swivel bearing 46. Attached at one end of the actuating lever 45 is the suction head 20, and at the other end an actuating member, namely a roller 47. A suction channel 48 runs inside the actuating lever 45 to the suction head 20 or suction bores. The suction channel 48 is connected via a stationary connecting channel 49 to a main channel 50, which runs within the rotational axis of the transfer roller 18, 19 and is connected to a central negative pressure source. Arranged on the actuating lever 45 is a sealing piece 51, which acts together with a counterpiece in the region of the connecting channel 49.

During the roll-off procedure, i.e. the transport of a blank 10, the sealing piece 51 lies against the counterseal, thus maintaining an effective connection between the suction channel 48 and the connecting channel 49. For releasing the blank 10 to the conveying rollers 16, the suction head 20 is vented by turning the actuating lever 45 (counterclockwise). This causes the suction head 20 to draw back from the blank 10, on one hand, while on the other hand the seal in the region of the sealing piece 51 or connecting channel 49 is broken by lifting the sealing piece 51. This removes negative pressure in the region of the suction bores.

In order to carry out this venting procedure, the actuating lever 45 is manipulated by an adjusting member which can move synchronously with the drive of the transfer roller 18, 19. This is a pivotable—two-armed—pressure lever 52, which has at its free end region facing the transfer roller 18, 19 a supporting part 53, on which the roller rolls off. For this purpose the pressure lever 52 is brought into a working position by a pivoting movement. This movement is controlled by the rotating crank mechanism, namely by a cam disc 54 arranged on a shaft 37. The cam disc 54 has a control groove 55 in which a jockey roller 56 of a lever 57 runs. The lever 57 in turn actuates the pressure lever 52.

Movement gear 22 and differential gear 23 are situated in a special manner in a common gear housing 58 (FIG. 6). The shaft 37 of the movement gear 22 and the transmission shaft 36 of the differential gear are mounted in the lateral walls of the housing. The shaft 37 projects laterally from the gear housing 58. The crank gear, namely the crank arm 24 and strut 26 are positioned outside the gear housing 58. To ensure perfect power transmission, the crank gear—crank arm 24 and strut 26—is provided in double arrangement, namely with one crank gear on either side of the gear housing 58. In addition, the (two) struts 26 are arranged offset with respect to the transport rollers 18, 19. Accordingly, two swivel arms 28, arranged at an axial distance to one another, are provided which likewise lie offset to the transport rollers 18, 19.

Each of these swivel arms 28 is associated with a compensating lever 29. The two compensating levers 29 are connected to a common transverse shaft 59—outside the gear housing 58. The sublever 31 is arranged on the transverse shaft—inside the gear housing 58—as a roller lever. Mounted at its end is the guide roller 35 described above. The two compensating levers 29 can therefore be controlled by the common guide roller 35.

The (two) transfer rollers 18, 19 are arranged at an axial distance from the gear, so that the blanks 10 can be handled in an open area. The transfer rollers 18, 19 are mounted on a common transverse shaft, namely hollow shaft 61. The latter is connected to the two swivel arms 28. The toothed quadrant 41 is—in for the two transfer rollers 18, 19 in common—also attached to the hollow shaft 61, specifically in the region between the two swivel arms 28. The toothed rack 42 is arranged in the appropriate stationary position.

The hollow shaft 61 also serves to supply the transfer rollers 18, 19 with suction air. (Two) suction lines 62, 63 are connected to the hollow shaft 61 at an end set off from the transfer rollers 18, 19. The hollow shaft 61 is provided with two separate suction channels which each lead to one of the transfer rollers 18, 19. For this purpose, a concentric positioned suction pipe 64 is mounted within the hollow shaft 61. In the region of the outer transfer roller this pipe 64 leads into the main channel 50, which in turn is connected to the suction head 20 of the transfer roller 19. A ring channel 65 encircling the suction pipe 64 lead in corresponding fashion to the transfer roller 18 or to its suction head 20.

Another special feature is the two-track operational mode. The two blanks magazines 14, 15 are arranged at a small distance to one another corresponding to the spacing of the connecting blanks paths 17 to one another. The spacing of the blanks paths 17 is in turn determined by the spacing of the two respective pockets of the folding turret for the simultaneous production or folding of two packs. One example of this is described in EP 0 315 821. By virtue of the present embodiment, a transverse movement of the blanks for an orientation corresponding to the position of the pockets of the folding turret is thus avoided.

The blanks magazine 14, 15 is equipped with special members which facilitate the withdrawal procedure for the individual blanks.

Figure 4:
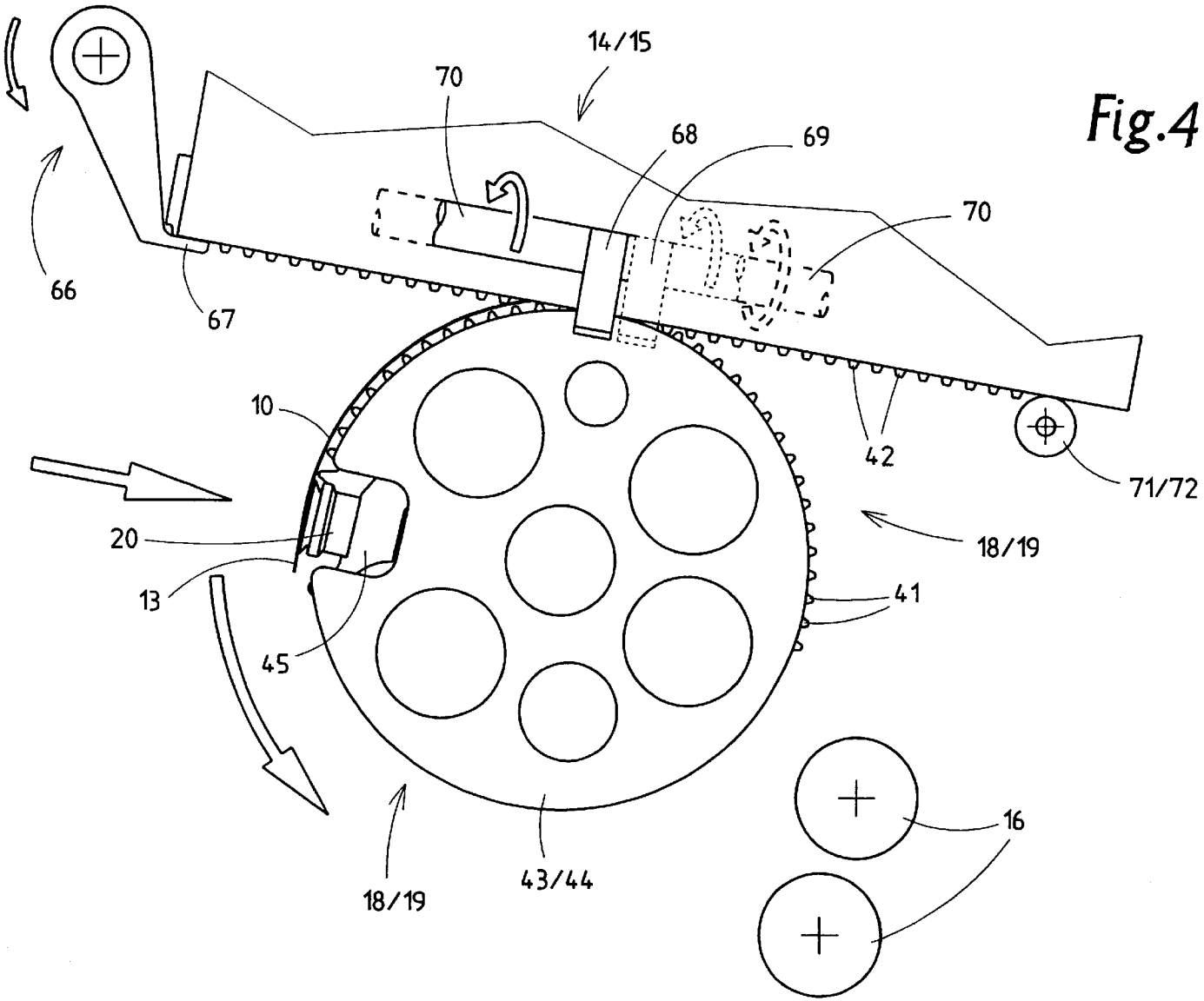

On the initial side of the withdrawal procedure, i.e. on the lid inner tab 13 side of the blank 10, a displaceable supporting member is arranged, namely a pivotable supporting lever 66, which enters in the region of the blanks 10 with an angled projection 67 on the bottom side of the blanks magazine 14, 15, thus supporting the blanks 10 from below. For the withdrawal procedure, the supporting lever 66 is moved out of its supporting position (FIG. 3). The movements are coordinated with each other so that the suction head 20 immediately assumes the supporting function of the supporting lever 66. After the withdrawal procedure has been initiated, the supporting lever 66 moves back to its supporting position (FIG. 4).

Furthermore, each blanks magazine 14, 15 is associated with two supporting levers 66, specifically in the region of the lid inner tab 13. The supporting levers 66 are spaced from another at a distance corresponding to the dimension of this tab. The supporting levers 66 of both blanks magazines 14, 15 are arranged on a mutual, synchronously operating actuating shaft 73 (FIG. 6).

Arranged approximately in the middle of the blanks magazines 14, 45 are additional, lateral supporting members. These are side levers 68, 69. Two side levers 68, 69 are assigned to each blanks magazine 14, 15. The side levers 68, 69 act in each region of the side tabs 11 of the blanks 10 by means of projections which can be moved against the bottom side of the blanks 10. The side levers 68, 69 are arranged on respective revolving rods 70. By rotating the latter, the side levers 68, 69 are either engaged or disengaged.

Positioned at the areas of the blanks 10 which are last withdrawn from the blanks magazine 14, 15 are additional stationary supporting members, namely supporting rollers 71, 72. Although mounted in place, they can rotate. The supporting rollers 71, 72 abut the respective bottom blank 10 in the region of its outer side tabs 12, specifically in a end region, so that the blanks 10 are drawn off by the supporting rollers 71, 72.

LIST OF DESIGNATIONS

10 blank
11 side tab
12 side tab
13 lid inner tab
14 blanks magazine
15 blanks magazine
16 conveying roller
17 blanks path
18 transfer roller
19 transfer roller
20 suction head
221 movement gear
23 differential gear
24 crank arm
26 strut
27 leveling piece
28 swivel arm
29 compensating lever
30 sublevers
31 sublevers
33 disc cam
34 control groove
35 guide roller
36 transmission shaft
37 shaft
38 cog wheel
39 cog wheel
41 toothed quadrant
42 toothed rack
43 roller disc
44 roller disc
45 actuating lever
46 swivel bearing
47 roller disc
48 suction channel
49 connecting channel
50 main channel
51 sealing piece
52 pressure lever
53 supporting part
54 cam disc
55 control groove
56 jockey roller
57 lever
58 gear housing
59 transverse shaft
61 hollow shaft
62 suction line
63 suction line
64 suction pipe
65 ring channel
66 supporting lever
67 projection
68 side lever
69 side lever
70 revolving rod
71 supporting roller
72 supporting roller
73 actuating shaft

What is claimed is:

1. Apparatus for handling blanks (10) in a packaging machine for the manufacture of cigarette packs of the hinge-lid type, with at least one blanks magazine (14, 15), from which blanks (10) can be removed individually by a withdrawal assembly with a transfer roller (18, 19) and fed to a discharge conveyor, in which the transfer roller (18, 19) can move back and forth at an open bottom side of the blanks magazine (14, 15), taking a blank (10) along its circumference in each case, characterized in that the transfer roller (18, 19) is attached to a bearing member which can be moved back and forth by a gear mechanism such that the transfer roller (18, 19) is moved back and forth along a straight-line path of movement, wherein the bearing member is a swivel arm (28) associated with each transfer roller (18, 19), the gear mechanism comprises a movement gear (22) and a differential gear (23), and the swivel arm (28) can be moved back and forth by means of the movement gear (22) and moved along a straightline path of movement with respect to the direction of movement by means of the differential gear (23).

2. Apparatus according to claim 1, characterized in that that the movement gear (22) is a crank mechanism with a rotating crank arm (24) and a strut (26) connected to the swivel arm (28) and that the differential gear (23) has a compensating lever (29) connected to the swivel arm (28), said compensating lever (29) being controlled by a control member in which runs a guide roller (35) connected to the compensating lever (29).

3. Apparatus according to claim 2, characterized in that the control member is a control groove (34) and the compensating lever (29) is configured as a two-armed lever with a fixed tilting bearing and that one end of the compensating lever (29) is guided with the swivel arm (29) and the other end of the compensating lever (29) is guided with the guide roller (35) in the control groove (34).

4. Apparatus according to claim 1, characterized in that the movement gear (22) and the differential gear (23) are gear-linked to one another by cog wheels (38, 39).

5. Apparatus according to claim 1, characterized in that a combination of the movement gear (22) and the differential gear (23) on a shaft (61) comprises a drive gear, and that the transfer roller (18, 19) is arranged offset to the drive gear and that the swivel arm (28) is connected to the shaft (61) offset with respect to the transfer roller (18, 19).

6. Apparatus according to claim 5, characterized in that that the transfer rollers (18, 19) associated with two swivel arms (28) arranged at a distance from one another, with the swivel arms (28) connected to the shaft (61) of the transfer roller (18, 19) and with each swivel arm (28) being associated with a compensating lever (29) and a strut (26).

7. Apparatus according to claim 5, characterized in that the transfer roller (18, 19) can be rotated by a toothed quadrant (41) in connection with a toothed rack (42), with the toothed quadrant (41) and the toothed rack (42) being arranged offset and at an axial distance to the transfer roller (18, 19) and the toothed quadrant being connected to the shaft (61).

8. Apparatus according to claim 1, characterized in that that the transfer roller (18, 19) has a suction head (20) for gripping a blank (10), that a suction channel (48) connected to a negative pressure source leads to the suction head (20), and that the suction channel (48) can be vented by means of an actuating member leading to an adjustable actuating member.

9. Apparatus according to claim 8, characterized in that the adjustable actuating member is a pressure lever (52) and the actuating member is a circular-shaped, two-armed actuating lever (45) that is pivotally mounted between roller discs (43, 44) of the transfer roller (18, 19), with one end of the actuating lever (45) interacting with the suction head (20) and the other end of the actuating lever (45) interacting with the pressure lever (52).

10. Apparatus according to claim 9, characterized in that there are a distal transfer roller (18) and a proximal transfer roller (19) arranged at a distance from one another in the axial direction and the shaft (61) serves to supply the suction heads (20) of transfer rollers (18, 19) with a suction pipe (64), the suction pipe (64) being arranged in concentric fashion within the shaft (61) and being associated with the distal transfer roller (18) and with a ring channel (65), which encircles the suction pipe (64)and is associated with the proximal transfer roller (19).

11. Apparatus according to claim 1, characterized in that, for two-track operations, two blanks magazines (14, 15) are arranged at a distance from one another which corresponds to the space between two blanks paths (17) connected to the blanks magazines (14, 15) or to the distance between two pockets of a folding turret.

12. Apparatus according to claim 11, characterized in that each blanks magazine (14, 15) is associated with at least one transfer roller (18, 19) and that all transfer rollers (18, 19) are mounted on shaft (61), and can be moved by same.

* * * * *